US011062829B2

(12) United States Patent
Fujimoto et al.

(10) Patent No.: US 11,062,829 B2
(45) Date of Patent: Jul. 13, 2021

(54) SOFT MAGNETIC ALLOY POWDER, PRODUCTION METHOD THEREOF, AND DUST CORE USING SAME

(71) Applicant: Panasonic Intellectual Property Management Co., Ltd., Osaka (JP)

(72) Inventors: Taishi Fujimoto, Osaka (JP); Masato Maede, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/249,807

(22) Filed: Jan. 16, 2019

(65) Prior Publication Data

US 2019/0252103 A1 Aug. 15, 2019

(30) Foreign Application Priority Data

Feb. 15, 2018 (JP) ..... JP2018-024600

(51) Int. Cl.
*B22F 3/00* (2021.01)
*H01F 1/28* (2006.01)
(Continued)

(52) U.S. Cl.
CPC ..... *H01F 1/28* (2013.01); *B22F 1/0014* (2013.01); *B22F 3/02* (2013.01); *B22F 9/04* (2013.01);
(Continued)

(58) Field of Classification Search
None
See application file for complete search history.

(56) References Cited

U.S. PATENT DOCUMENTS 4,844,355 A * 7/1989 Kemp, Jr. ..... B01F 7/00175 241/172
7,821,371 B2 10/2010 Inoue et al.
(Continued)

FOREIGN PATENT DOCUMENTS

CN 104036902 A 9/2014
JP 5-326239 A 12/1993
(Continued)

OTHER PUBLICATIONS

Merriam-Webster Dictionary, "Pulverize", accessed Jun. 30, 2020, Merriam-Webster.com Dictionary, https://www.merriam-webster.com/dictionary/pulverize. (Year: 2020).*
(Continued)

*Primary Examiner* — Seth Dumbris
*Assistant Examiner* — Kim S. Horger
(74) *Attorney, Agent, or Firm* — McDermott Will & Emery LLP

(57) ABSTRACT

A soft magnetic alloy powder includes a first pulverized powder which has a particle diameter of 20 μm or more, a value of major diameter/minor diameter of 1.2 or more and 1.8 or less, and a flat plate shape, and a second pulverized powder which has a particle diameter of less than 3 μm, a value of major diameter/minor diameter of 1.1 or more and 1.6 or less, and a flat plate shape. A production method of a soft magnetic alloy powder, includes first processing of processing a soft magnetic alloy ribbon into a coarse powder, and second processing of pulverizing the coarse powder with a pulverizer.

9 Claims, 5 Drawing Sheets

(51) Int. Cl.

| | |
|---|---|
| ***H01F 1/22*** | (2006.01) |
| ***B22F 9/04*** | (2006.01) |
| ***B22F 1/00*** | (2006.01) |
| ***C22C 38/12*** | (2006.01) |
| ***C22C 38/02*** | (2006.01) |
| ***B22F 3/02*** | (2006.01) |
| ***C22C 38/16*** | (2006.01) |
| ***H01F 3/08*** | (2006.01) |
| *H01F 1/153* | (2006.01) |

(52) U.S. Cl.
CPC ..... *C22C 38/02* (2013.01); *C22C 38/12* (2013.01); *C22C 38/16* (2013.01); *H01F 1/22* (2013.01); *H01F 3/08* (2013.01); *B22F 2009/048* (2013.01); *B22F 2301/35* (2013.01); *C22C 2202/02* (2013.01); *H01F 1/15308* (2013.01)

(56) References Cited

U.S. PATENT DOCUMENTS

| | | | | |
|---|---|---|---|---|
| 2011/0080248 | A1 | 4/2011 | Nishimura | |
| 2016/0086715 | A1* | 3/2016 | Lin | C22C 45/02 336/221 |
| 2016/0086728 | A1 | 3/2016 | Suetsuna et al. | |
| 2016/0104937 | A1* | 4/2016 | Kumura | G06K 19/07794 343/788 |
| 2016/0211061 | A1 | 7/2016 | Masuda et al. | |
| 2016/0298216 | A1* | 10/2016 | Kino | C22C 33/003 |
| 2017/0209924 | A1* | 7/2017 | Suetsuna | C22C 38/02 |

FOREIGN PATENT DOCUMENTS

| | | |
|---|---|---|
| JP | 4944971 B | 6/2012 |
| JP | 2016-060956 | 4/2016 |
| WO | 2007/052528 | 5/2007 |
| WO | 2015/049993 | 4/2015 |

OTHER PUBLICATIONS

Laerd Statistics, "Measures of Central Tendency", 2011, 6 pages, accessed online Jan. 27, 2021 at statistics.laerd.com/statistical-guides/measures-central-tendency-mean-mode-median and time-stamped by web.archive.org (Year: 2011).*

English Translation of Chinese Search Report dated Oct. 12, 2020 for the related Chinese Patent Application No. 201910042282.4.

* cited by examiner

PRIOR ART

SOFT MAGNETIC ALLOY POWDER, PRODUCTION METHOD THEREOF, AND DUST CORE USING SAME

TECHNICAL FIELD

The technical field relates to a soft magnetic alloy powder used for inductors such as a choke coil, a reactor, and a transformer, a production method thereof, and a dust core using the same.

BACKGROUND

In recent years, vehicle electrification such as a hybrid electric vehicle (HEV), a plug-in hybrid electric vehicle (PHEV), and an electric vehicle (EV) has rapidly advanced, and it is required to reduce a size and a weight of a system in order to further improve fuel efficiency. Driven by an electrification market thereof, reduction in a size and a weight is required for various electronic components, soft magnetic alloy powder used in a choke coil, a reactor, a transformer, and the like, and a dust core using the same are required to have higher performance.

In the soft magnetic alloy powder and the dust core using the same, in order to reduce the size and the weight, as a material, it is excellent to have a high saturated magnetic flux density, core loss is required to be low, and it is required to be excellent in direct current superimposition characteristics.

For example, Japanese Patent No. 4944971 describes a method of achieving low core loss and excellent direct current superimposition characteristic, which are features of amorphous soft magnetic alloy, by mixing a pulverized powder and an atomized spherical powder.

FIGS. 5A to 5C show a pulverized powder of a ribbon, which is obtained by crushing an amorphous soft magnetic alloy ribbon and is described in Japanese Patent No. 4944971. FIG. 5A shows pulverized powder 1 having a particle diameter of 50 μm or more. FIG. 5B shows pulverized powder 2 having the particle diameter of 50 μm or less. FIG. 5C shows atomized spherical powder 3.

Japanese Patent No. 4944971 describes a dust core including, as main components, pulverized powders 1 and 2 of an amorphous alloy ribbon and atomized spherical powder 3 of an amorphous alloy. Pulverized powders 1 and 2 are laminar and have two opposed main surfaces. When regarding the minimum value in a plane direction of the main surface as a particle diameter, pulverized powder 1, of which the particle diameter is more than twice (25 μm×2=50 μm) a thickness (ribbon thickness of 25 μm) of the pulverized powder and less than or equal to 6 times (25 μm×6=150 μm) the thickness of the pulverized powder, is 80 mass % or more of a total pulverized powder and pulverized powder 2, of which the particle diameter is less than or equal to twice (25 μm×2=50 μm) the thickness of pulverized powder, is 20 mass % or less of the total pulverized powder.

Further, the particle diameter of atomized spherical powder 3 is less than or equal to a half thickness (25×½=12.5 μm) of the ribbon thickness (25 μm) and 3 μm or more.

SUMMARY

However, in Japanese Patent No. 4944971, the pulverized powders 1 and 2 of the ribbon are flattened, whereas the atomized spherical powder 3 is spherical. Therefore, since shapes thereof are different, a contact area between the pulverized powders and the atomized powder is small when entering around the pulverized powders. Accordingly, when mixing them, the spherical powder cannot sufficiently fill voids of the pulverized powders. Accordingly, a packing ratio does not increase. Further, relative permeability and a saturated magnetic flux density decrease.

The present disclosure is intended to solve the above problems and an object thereof is to provide a soft magnetic alloy powder which can obtain excellent soft magnetic characteristics only with a flat pulverized powder of a soft magnetic alloy ribbon, a production method thereof, and a dust core using the same.

In order to achieve the object, a soft magnetic alloy powder including a first pulverized powder which has a particle diameter of 20 μm or more and a value of major diameter/minor diameter of 1.2 or more and 1.8 or less, and has a flat plate shape, and a second pulverized powder which has a particle diameter of less than 3 μm and a value of major diameter/minor diameter of 1.1 or more and 1.6 or less, and has a flat plate shape is used.

A production method of a soft magnetic alloy powder, including first processing of processing a soft magnetic alloy ribbon into a coarse powder, and second processing of pulverizing the coarse powder with a pulverizer is used.

As described above, according to means disclosed in an embodiment, it is possible to provide a soft magnetic alloy powder which can improve relative permeability and saturated magnetic flux density and obtain excellent magnetic property, and a production method thereof, and a dust core using the same.

DESCRIPTION OF THE EMBODIMENTS

Hereinafter, embodiments of the present disclosure will be described with reference to the drawings.

Structure

Figure 1A:
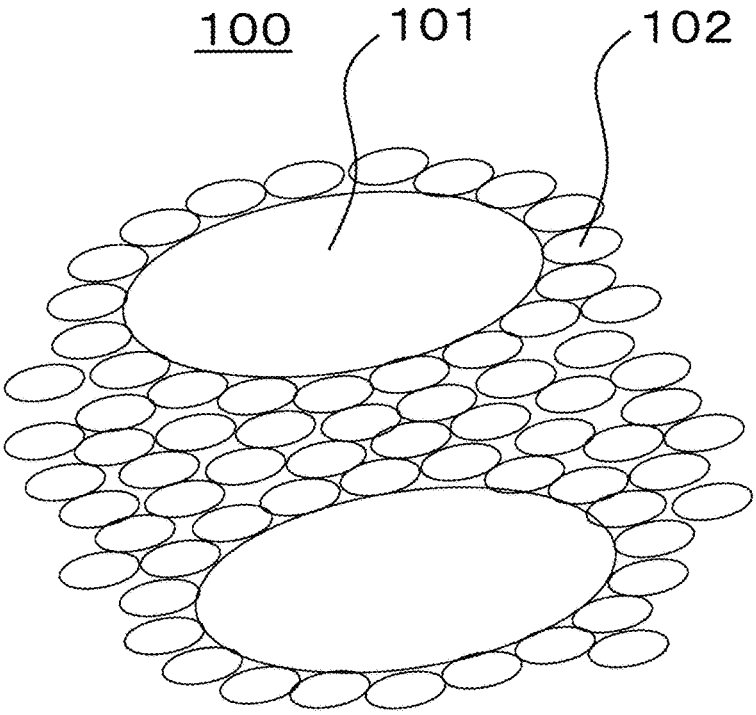
FIG. 1A is a diagram showing a soft magnetic alloy powder including only pulverized powders of an embodiment.

FIG. 1A shows a sectional diagram of soft magnetic alloy powder 100 in an embodiment of the present disclosure.

Soft magnetic alloy powder 100 includes first pulverized powder 101 and second pulverized powder 102.

First pulverized powder 101 has a particle diameter of 20 μm or more, a value of major diameter/minor diameter of a plane of 1.2 or more and 1.8 or less, and a flat plate shape.

Second pulverized powder 102 has a particle diameter of less than 3 μm, a value of major diameter/minor diameter of a plane of 1.1 or more and 1.6 or less, and a flat plate shape. The major diameter/minor diameter of the plane is a ratio between a major diameter and a minor diameter in the largest plane of one particle having the flat plate shape.

First pulverized powder 101 preferably has the particle diameter of 20 μm or more and the value of the major diameter/minor diameter of 1.4 or more and 1.6 or less.

Second pulverized powder 102 preferably has a particle diameter of less than 3 μm and a value of major diameter/minor diameter of a plane of 1.2 or more and 1.4 or less.

In the present specification, the particle diameter and the major diameter/minor diameter are respectively average values of particles. In the present specification, the particle diameter is a value obtained by diluting and stirring a sample with water to perform measuring under a room temperature using a laser diffraction-scattering particle diameter distribution measuring device "Microtrac MT3000(II) series" (MicrotracBEL Corp.).

When second pulverized powder 102 having a small value of major diameter/minor diameter enters first pulverized powder 101 having a large value of major diameter/minor diameter, a contact area between first pulverized powder 101 and second pulverized powder 102 increases, whereby a packing ratio increases.

In addition, a thickness of each of first pulverized powder 101 and second pulverized powder 102 may be 1 μm or more and 50 μm or less. Further, the thickness of each of first pulverized powder 101 and second pulverized powder 102 is preferably 10 μm or more and 40 μm or less.

The thinner the thickness of first pulverized powder 101 and second pulverized powder 102, the better the thermal responsiveness of each powder during a heat treatment and the better the relative permeability and the saturated magnetic flux density.

Related Art Example

Figure 1B:
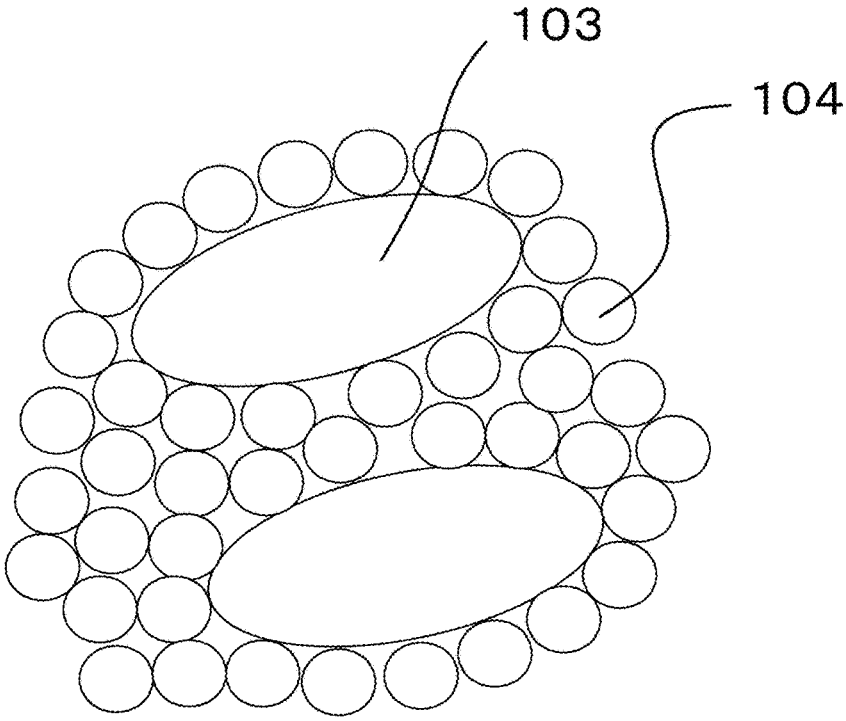
FIG. 1B RELATED ART
FIG. 1B is a diagram showing a soft magnetic alloy powder obtained by mixing a pulverized powder and an atomized spherical powder of the related art.

FIG. 1B shows a sectional diagram of a mixture of a pulverized powder and an atomized powder, which is a related art example of Japanese Patent No. 4944971. As shown in FIG. 1B, in a case of a mixed powder of pulverized powder 103 having a particle diameter of 20 μm or more and atomized powder 104 having a particle diameter of 3 μm or more, since atomized powder 104 has a spherical shape, when atomized powder 104 enters around pulverized powder 103, a contact area between pulverized powder 103 and atomized powder 104 is small. Accordingly, the packing ratio decreases compared to a case of FIG. 1A.

Next, a production method of a soft magnetic alloy powder and a dust core of an embodiment will be described.

Production of Soft Magnetic Alloy Powder 100

Figure 2:
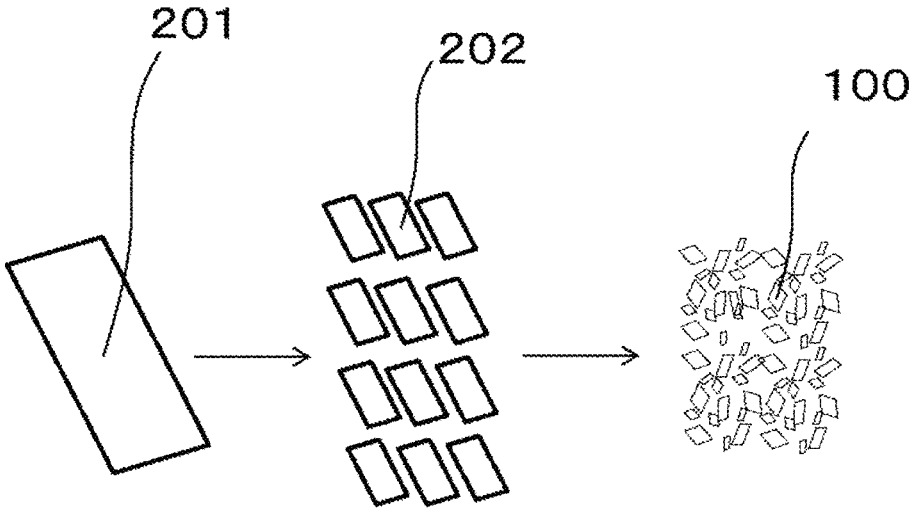
FIG. 2 is a diagram showing a producing step of a pulverized powder of a soft magnetic alloy ribbon of the embodiment.

The production method of soft magnetic alloy powder 100 will be described using FIG. 2.

Production of Fe-Based Soft Magnetic Alloy Ribbon 201

An alloyed Fe-based alloy composition is melted by high-frequency heating or the like using arc melting or the like, and Fe-based soft magnetic alloy ribbon 201 is produced by a liquid quenching method. In this case, a thickness of Fe-based soft magnetic alloy ribbon 201 may be 20 μm or more and 40 μm or less.

As the liquid quenching method used for producing soft magnetic alloy ribbon 201, a single roll production apparatus or a twin roll production apparatus can be used. The melted soft magnetic alloy is applied on a surface of a roll and quenched to produce a ribbon.

Primary Processing

Next, soft magnetic alloy ribbon 201 is finely cut to 1 mm square without using a pulverizer to produce coarse powder 202. Soft magnetic alloy ribbon 201 is processed so as to have a certain size without using the pulverizer.

In this case, the size of soft magnetic alloy ribbon 201 is made finer in advance before pulverizing. Accordingly, it is possible to suppress crushing energy generated at the time of pulverizing. When performing the pulverizing, as an apparatus used for shredding soft magnetic alloy ribbon 201, a microcut shredder, a cutter, and the like can be used.

An apparatus, which cuts a sheet in a plane direction, not in a thickness direction, rather than the pulverizer producing a powder is used. By making the ribbon smaller in advance in the primary processing, a powder having a wide particle size distribution can be produced finally. A size is preferably 1 mm square or less.

Secondary Processing

Next, shredded coarse powder 202 is pulverized to obtain soft magnetic alloy powder 100. For pulverizing the soft magnetic alloy ribbon or a flake, a general pulverizing apparatus can be used. The pulverizing means that a sheet (a particle) is split not only in the thickness direction but also in the plane direction.

For example, a ball mill, a stamp mill, a planetary mill, a cyclone mill, a jet mill, a rotary mill, and the like can be used.

In addition, fine powder obtained by pulverizing is classified using a sieve to obtain soft magnetic alloy powder 100 having a desired particle size distribution.

Production Mechanism

Figure 3:
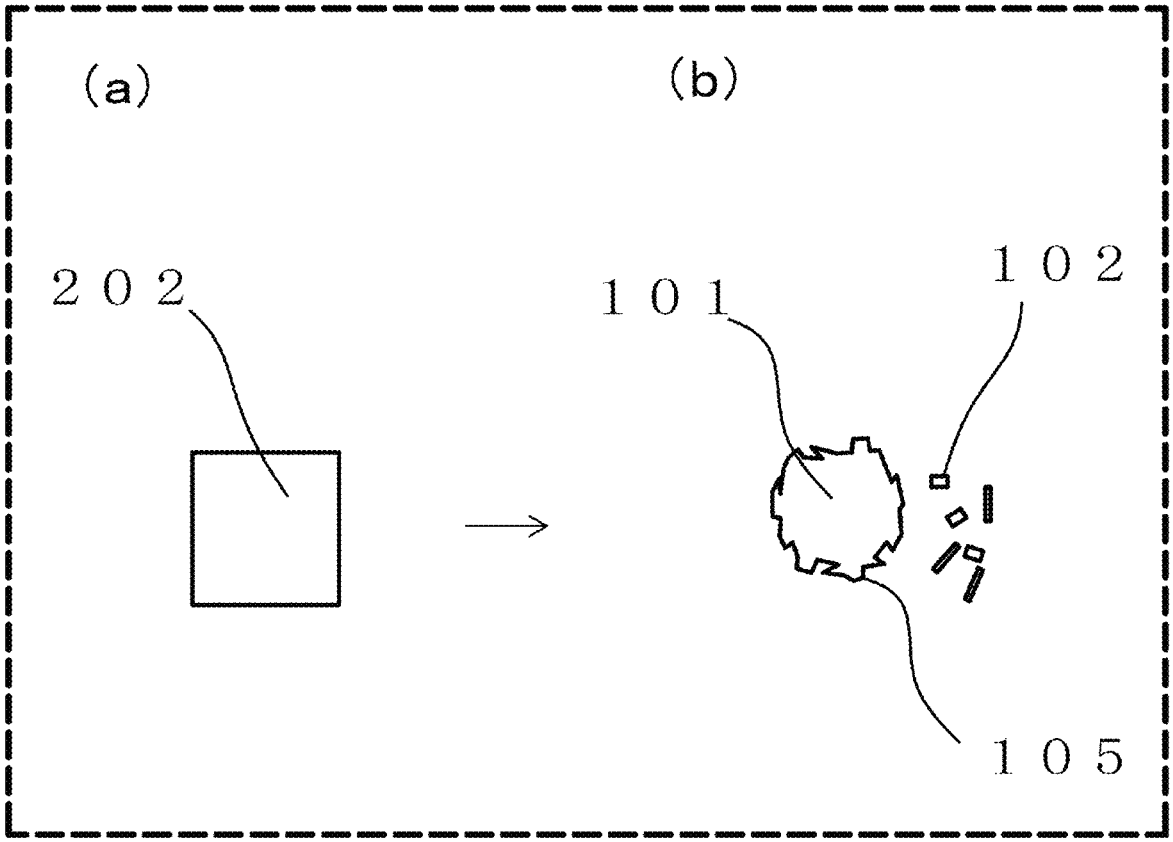
FIG. 3 is a diagram showing a pulverizing mechanism of the pulverized powder produced from the soft magnetic alloy ribbon of the embodiment.

A production mechanism for producing soft magnetic alloy powder 100 using coarse powder 202 will be described using FIG. 3. Coarse powder 202 shown in (a) of FIG. 3 is pulverized by a pulverizer such as a rotary mill. As a result, as shown in (b) of FIG. 3, a surface of coarse powder 202 is cleaved, second pulverized powder 102 is scraped off, and first pulverized powder 101 having pulverization mark 105 on a surface thereof is obtained. The surface of coarse powder 202 is cleaved, thereby obtaining rounded first pulverized powder 101 which has a particle diameter of 20 μm or more and no corner.

In addition, a surface of second pulverized powder 102 is also cleaved with the same mechanism to obtain a rounded shape with no corner.

Heat Treatment

Next, first pulverized powder 101 and second pulverized powder 102 are heat-treated to remove an internal strain caused by the pulverizing or to precipitate a α-Fe crystal layer. As a heat treating apparatus, for example, a hot air furnace, a hot press, a lamp, a sheath metal heater, a ceramic heater, a rotary kiln, and the like can be used. In this case, by rapid heating using hot press or the like, crystallization further proceeds and the cleavage of the surface of first pulverized powder 101 further proceeds. Accordingly, a ratio of the pulverized powder having a small particle diameter increases.

Production of Dust Core

In the production of a dust core in the embodiment, a granulated powder is produced with first pulverized powder 101, second pulverized powder 102, and a binder such as a phenolic resin and a silicone resin, which is favorable in insulation property and has high heat resistance, by using a mixing and stirring machine.

Next, a die having a desired shape and high heat resistance is filled with the granulated powder, and pressure forming is performed to obtain a green compact. Thereafter, heating is performed at a temperature at which the binder is cured. Accordingly, a dust core having high relative permeability and high saturated magnetic flux density is obtained.

EXAMPLE

As an Fe-based soft magnetic alloy ribbon of Fe 73.5-Cu 1-Nb 3-Si 13.5-B 9 (at %), which was produced by a quenching single roll method, soft magnetic alloy ribbon 201 having a thickness of 20 μm or more and 40 μm or less was used.

Soft magnetic alloy ribbon 201 was finely cut to 1 mm square to produce coarse powder 202.

Thereafter, coarse powder 202 was pulverized with a rotary mill to obtain first pulverized powder 101 and second pulverized powder 102 of the soft magnetic alloy ribbon. A pulverizing time was 3 minutes for coarse pulverizing and 3 minutes for fine pulverizing. After the pulverizing, classifying was performed using a sieve to obtain pulverized powder of the soft magnetic alloy having a desired particle size distribution. Next, soft magnetic powders which are the pulverized powder were granulated using a silicone resin as a binder to produce a granulated powder.

Next, the granulated powder was charged into a die and pressure forming was performed using a pressing machine at a forming pressure of 4 ton/cm$^2$ to produce a green compact.

For each green compact obtained, relative permeability at a frequency of 100 kHz was measured using an impedance analyzer. When an acceptance criterion of the relative permeability was set to 25 or more, the acceptance criterion was satisfied. The acceptance criterion was targeted to be higher than or equal to relative permeability of a metallic material of the related art. Accordingly, a dust core having high relative permeability was used.

COMPARATIVE EXAMPLE

As Fe-based soft magnetic alloy ribbon 201 of Fe 73.5-Cu 1-Nb 3-Si 13.5-B 9 (atomic %), which was produced by a quenching single roll method, a ribbon having a thickness of 20 μm or more and 40 μm or less was used. The ribbon was finely cut to 10 mm square to obtain a coarse powder. The coarse powder was pulverized with a rotary mill to obtain a pulverized powder of the soft magnetic alloy ribbon.

A pulverizing time was 3 minutes for coarse pulverizing and 3 minutes for fine pulverizing. After the pulverizing, classifying was performed using a sieve to obtain pulverized powder of the soft magnetic alloy having a desired particle size distribution. Next, soft magnetic powders which are the pulverized powder were granulated using a silicone resin as a binder to produce a granulated powder.

Next, the granulated powder was charged into a die and pressure forming was performed using a pressing machine at a forming pressure of 4 ton/cm$^2$ to produce a green compact.

For each green compact obtained, relative permeability at a frequency of 100 kHz was measured using an impedance analyzer. When an acceptance criterion of the relative permeability was set to 25 or more, the acceptance criterion was not satisfied. The acceptance criterion was targeted to be higher than or equal to relative permeability of a metallic material of the related art.

Shape of Pulverized Powder

In both Example and Comparative Example, since pulverizing was performed using the rotary mill as described above, a surface was cleaved to form a rounded shape which had a particle diameter of 20 μm or more and no corner.

Particle Size Distribution

Figure 4A:
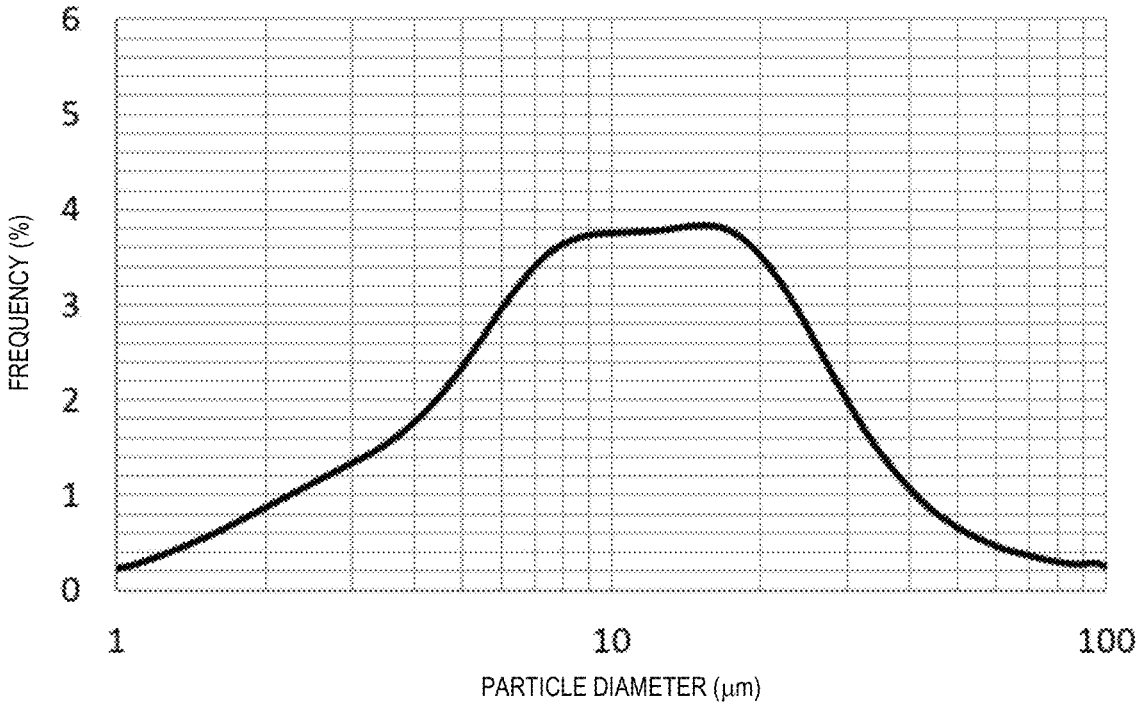
FIG. 4A is a chart showing a particle size distribution of a pulverized powder in Example of the present disclosure.
Figure 4B:
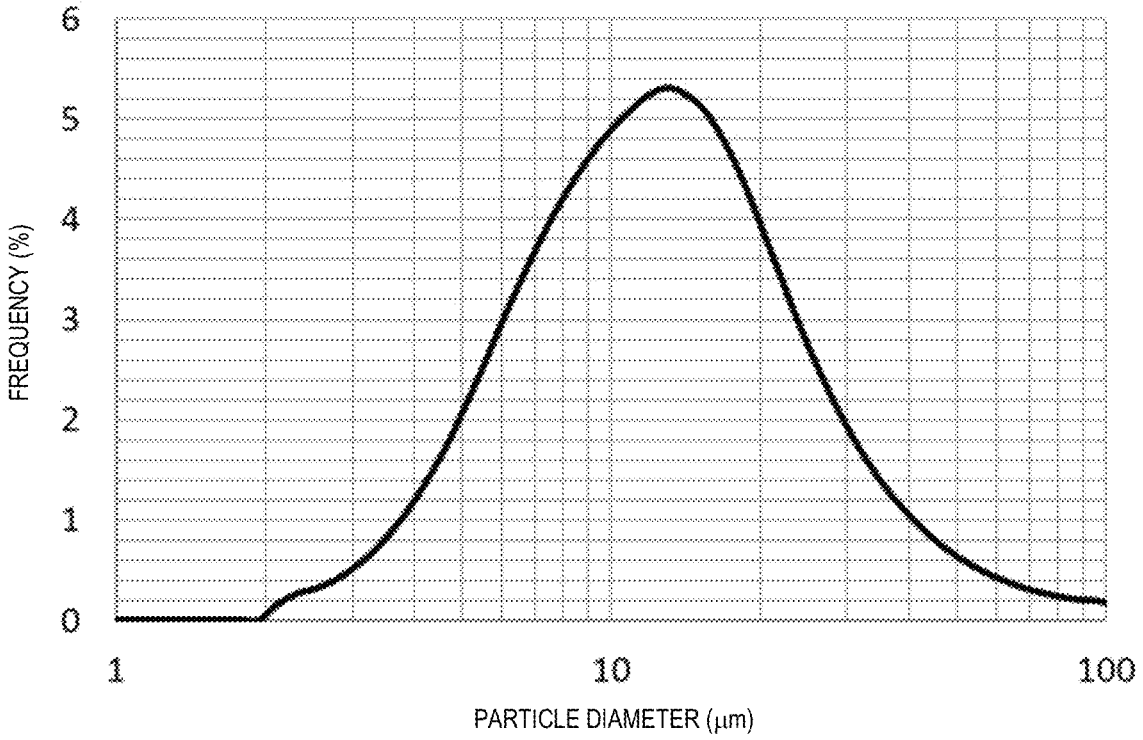
FIG. 4B is a chart showing a particle size distribution of a pulverized powder in Comparative Example.
Figure 5A:
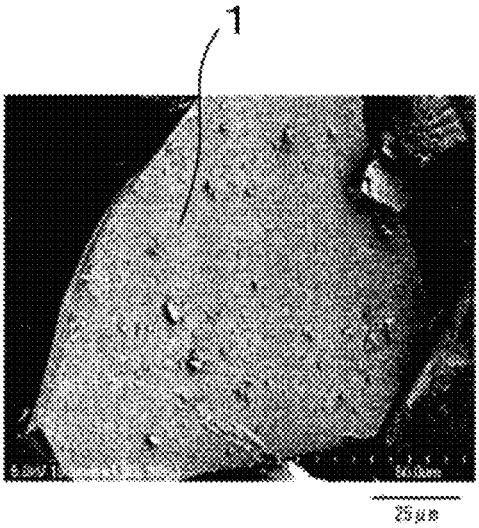
FIG. 5A PRIOR ART
FIG. 5A is a view showing a pulverized powder having a particle diameter of 50 μm or more, described in Japanese Patent No. 4944971.
Figure 5B:
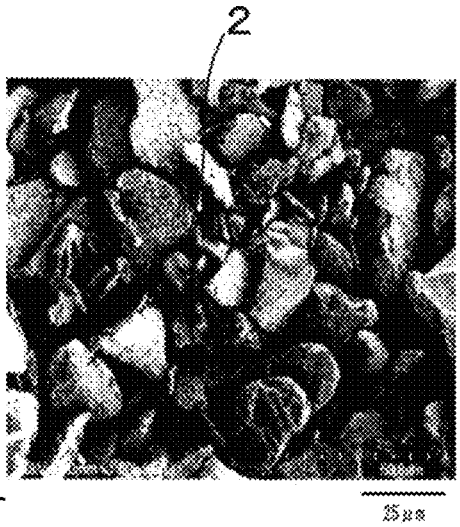
FIG. 5B is a view showing a pulverized powder having a particle diameter of 50 μm or less, described in Japanese Patent No. 4944971.
Figure 5C:
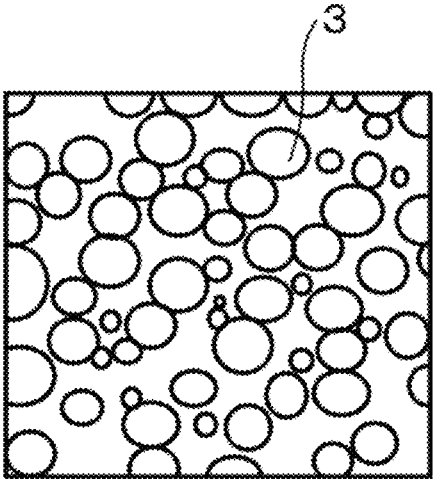
FIG. 5C PRIOR ART
FIG. 5C is a diagram showing an atomized spherical powder described in Japanese Patent No. 4944971.

A particle size distribution of each of the pulverized powders, of the soft magnetic alloy ribbon, obtained by pulverizing was measured using the Microtrac MT3000(II) series. FIGS. 4A and 4B show the particle size distributions of the pulverized powders respectively in Example and Comparative Example. In FIGS. 4A and 4B, a horizontal axis represents a particle diameter (μm), and a vertical axis represents an existence frequency of pulverized powders having respective particle diameters.

Regarding cumulative distribution, in Example of FIG. 4A, as an average particle diameter, D10% was 2.85 μm, D50% was 10.47 μm, and D90% was 29.47 μm. On the other hand, in Comparative Example of FIG. 4B, as an average particle diameter, D10% was 5.139 μm, D50% was 10.89 μm, and D90% was 28.34 μm.

Here, D10% is a particle diameter of a particle at a position of 10% from a smaller particle when a total number was regarded as 100%.

It was summarized in Table 1 below.

TABLE 1

| | Examples | Comparative Example |
|---|---|---|
| Size of ribbon as pulverized raw material | 1 mm square | 10 mm square |
| D10% | 2.85 μm | 5.139 μm |
| D50% | 10.47 μm | 10.89 μm |
| D90% | 29.47 μm | 28.34 μm |
| D10%/D50% | 0.272 | 0.472 |
| Relative permeability | 25 or more | 24 |
| Acceptance | Pass | Fail |

In addition, D10%/D50% which is a ratio of the cumulative distribution was 0.272 in Example of FIG. 4A. The D10%/D50% was 0.472 in Comparative Example of FIG. 4B. The smaller the value, the wider the width of particle size distribution. That is, a ratio of fine particles increases.

Therefore, regarding the cumulative distribution of pulverized powder, as an average particle diameter, D10% may be less than 3 μm and D50% may be 10 to 15 μm, and D10%/D50% which is a ratio of the cumulative distribution may be less than 0.30.

When the average particle diameter D50% was targeted to be within a range of 10 to 15 μm, if the ratio of the fine particles is large and a ratio of the coarse particles is small, the fine particles enter a void of the coarse particles and the density improves. Accordingly, a value of the average particle diameter D10% is may be smaller, and the value of D10%/D50% which represents a wide width of the particle size distribution may be small.

Regarding the cumulative distribution of the pulverized powder, D10% is preferably 1 μm or less, D50% is preferably 10 to 15 μm, and D10%/D50% which is the ratio of the cumulative distribution is preferably 0.20 or less.

As described above, by making the size of soft magnetic alloy ribbon 201 before pulverizing small, it is possible to create a broad particle size distribution in which the ratio of the fine particles as shown in FIG. 4A is large and the width of the particle size distribution is wide. As a result, since the ratio of the fine particles increases, second pulverized powder 102 easily enters first pulverized powder 101.

Further, since it is configured of only the pulverized powders and the particles have the same shape, porosity becomes low. Accordingly, a soft magnetic alloy powder having excellent magnetic properties in which the relative permeability and saturated magnetic flux density are high is obtained.

From this result, it is possible to further reduce the porosity and improve the relative permeability and the saturated magnetic flux density, by further reducing the size of coarse powder 202 to less than 1 mm square.

Accordingly, the size of coarse powder 202 may be 1 mm square or less.

The soft magnetic alloy powder of the embodiment includes only first pulverized powder 101 and second pulverized powder 102. However, the soft magnetic alloy powder of the embodiment may include first pulverized powder 101 and second pulverized powder 102, as main components. The main components are 80% or more. At least the soft magnetic alloy powder of the embodiment may contain other pulverized powder naturally in some cases.

A ratio of the number of first pulverized powder 101 and the number of second pulverized powder 102 is 2:3. The ratio of the number of first pulverized powder 101 and the number of second pulverized powder 102 is preferably within a range of 3 to 5:5 to 7.

As can be seen from a comparison between FIG. 4A and FIG. 4B, in the embodiment, in a graph of particle diameter and frequency, it can be seen that there are separate two peaks attributed to first pulverized powder 101 and second pulverized powder 102.

Advantageous Effects of Disclosure

Advantageous effects of the present disclosure will be described with reference to FIGS. 4A and 4B.

The smaller the size of coarse powder 202 before pulverizing, the more the possibility to create a broad particle size distribution in which the ratio of the fine particles is large and the width of the particle size distribution is wide.

When the width of the particle size distribution is wide as shown in FIG. 4A, it is possible to produce many particles with large and small particle diameters, compared to FIG. 4B with a narrow width of the particle size distribution. Further, since the ratio of the fine particles is large, the fine particles enter around the large particles and the porosity can be reduced.

Further, as shown in FIG. 1A, the soft magnetic powder is configured of only the pulverized powder having a flat plate shape, and has the same shape. From this, it is easier to fill voids than in the powder obtained by mixing pulverized powder 103 and atomized powder 104 shown in FIG. 1B of the related art example. As a result, a configuration including only the pulverized powder having a flat plate shape of FIG. 1A has the porosity lower than that of the mixed powder of pulverized powder 103 and atomized powder 104 of FIG. 1B. Therefore, it is possible to improve the relative permeability and the saturated magnetic flux density.

According to the embodiment of the present disclosure, it is possible to improve the relative permeability and the saturated magnetic flux density of the soft magnetic alloy powder. That is, it is possible to provide a soft magnetic alloy powder capable of obtaining excellent soft magnetic characteristics.

What is claimed is:

1. A soft magnetic alloy powder comprising:

a first pulverized powder which has an average particle diameter of 20 μm or more, an average value of major diameter/minor diameter of 1.2 or more and 1.8 or less, and a flat plate shape; and a second pulverized powder which has an average particle diameter of less than 3 μm, an average value of major diameter/minor diameter of 1.1 or more and 1.6 or less, and a flat plate shape, wherein the average value of major diameter/minor diameter of the first pulverized powder is greater than the average value of major diameter/minor diameter of the second pulverized powder.

2. The soft magnetic alloy powder of claim 1, wherein a thickness of each of the first pulverized powder and the second pulverized powder is 10 μm or more and 40 μm or less.

3. The soft magnetic alloy powder of claim 1, wherein the soft magnetic alloy powder has a cumulative distribution in which D10% is less than 3 μm and D50% is 10 to 15 μm.

4. The soft magnetic alloy powder of claim 1, wherein the soft magnetic alloy powder has a cumulative distribution ratio D10%/D50% of less than 0.30.

5. The soft magnetic alloy powder of claim 1, consisting of:

the first pulverized powder; and the second pulverized powder.

6. The soft magnetic alloy powder of claim 1, wherein, in a graph of a particle diameter and a frequency, there are separate two peaks of a peak of the first pulverized powder and a peak of the second pulverized powder.

7. The soft magnetic alloy powder of claim 1, wherein a ratio in the number of the first pulverized powder and the second pulverized powder is N1:N2, where N1 is between 3 to 5 and N2 is between 5 to 7.

8. A dust core comprising:

the soft magnetic alloy powder of claim 1; and a binder.

9. The soft magnetic alloy powder of claim 1, wherein the soft magnetic alloy powder is Fe-based soft magnetic alloy.

* * * * *